United States Patent [19]

Ushikubo

[11] Patent Number: 4,986,965

[45] Date of Patent: Jan. 22, 1991

[54] LIQUID CONTAINER FOR USE IN BIOCHEMICAL ANALYSIS

[75] Inventor: Masao Ushikubo, Hachioji, Japan

[73] Assignee: Olympus Optical Co., Ltd., Tokyo, Japan

[21] Appl. No.: 896,312

[22] Filed: Aug. 15, 1986

Related U.S. Application Data

[63] Continuation of Ser. No. 665,944, Oct. 29, 1984, abandoned.

[30] Foreign Application Priority Data

Nov. 1, 1983 [JP] Japan ..... 58-168338

[51] Int. Cl.[5] ..... B65D 23/06

[52] U.S. Cl. ..... 422/102; 422/104; 435/296; 73/864.91; 220/85 H; 220/DIG. 21

[58] Field of Search ..... 422/102, 104; 435/296; 73/864.91; 220/469, 85 H, DIG. 21

[56] References Cited

U.S. PATENT DOCUMENTS

| | | | |
|---|---|---|---|
| 134,302 | 12/1872 | Miller | 220/DIG. 21 |
| 1,334,342 | 3/1920 | Woods | 200/85 H |
| 1,683,176 | 9/1928 | Faulhaber | 200/DIG. 21 |
| 1,759,589 | 5/1930 | Peters | 126/385 |
| 2,868,411 | 1/1959 | Kesselman | 220/85 H |
| 3,933,440 | 1/1976 | Woolley | 422/102 |
| 3,938,961 | 2/1976 | Lanier | 422/102 |
| 4,007,012 | 2/1977 | Greenwald | 422/102 |
| 4,073,693 | 2/1978 | Janin | 422/102 |
| 4,483,616 | 11/1984 | Liston et al. | 422/102 |
| 4,599,314 | 7/1986 | Shami | 422/102 X |

*Primary Examiner*—David L. Lacey

*Attorney, Agent, or Firm*—Stevens, Davis, Miller & Mosher

[57] ABSTRACT

A container for containing a liquid for use in a biochemical analysis includes a cylindrical inner side wall, a bottom wall connected to the inner side wall at its lower end and a cylindrical outer side wall surrounding concentrically the inner side wall and being separated from the inner side wall to form a ring-shaped recess therebetween. Even if the liquid overflows beyond the inner side wall, an outer surface of the outer side wall is kept free from the liquid and the operator's fingers are protected against contamination by the liquid.

1 Claim, 3 Drawing Sheets

LIQUID CONTAINER FOR USE IN BIOCHEMICAL ANALYSIS

This application is a continuation of application Ser. No. 665,944 filed Oct. 29, 1984, now abandoned.

BACKGROUND OF THE INVENTION

The present invention relates to a container for containing a liquid for use in a biochemical analysis.

In biochemical analysis, various kinds of containers are used such as sample containers for containing samples such as blood serums, reagent containers for containing various kinds of reagents, and reaction vessels for containing mixtures of samples and reagents, i.e. test liquids.

FIG. 1A and 1B are perspective and cross sectional views, respectively showing a typical known container for containing a sample. A sample container 1 comprises a cylindrical side wall 2 having an opening 3 formed at one side thereof and a bottom wall 4 integrally formed with the other side of the cylindrical side wall 2. In case of handling such a container 1, an operator pinches the container 1 between his thumb and index finger. Therefore, if the sample is applied on an outer surface of side wall 2, the fingers of the operator might be contaiminated with the sample. It should be noted that the sample is sometimes applied on the outer surface of the side wall 2 during a delivery of the sample into the container 1 through the opening 3 by means of a pipette. Moreover, when the container 1 containing the sample is manually set in an automatic or semiautomatic chemical analyzer, the sample might overflow out of the container due to possible vibration and shock and the fingers might be contaminated with the sample which, as a result, overflows. In this manner, in case of handling the known sample container, the fingers of the operator might make contact with the sample. If a sample is a serum containing harmful components such as HB antigen, there is a great danger that the operator might be infected with them. Such a situation is very dangerous and should be avoided completely. This will be equally applied to the reagent container and reaction vessel.

Recently, an amount of the sample to be processed by the chemical analyzer has been reduced, and therefore, the sample container for containing such a small amount of the sample is made smaller. It is apparent that it is rather difficult for the operator to handle such a small container. In some cases the operator might turn over the container and his fingers might be contaminated with the harmful sample.

SUMMARY OF THE INVENTION

The present invention has for its object to provide a novel and useful liquid container for use in a biochemical analysis, whose outermost surface can be completely free from a liquid and an operator can be effectively protected against contamination with the liquid.

It is another object of the invention to provide a liquid container which can be handled easily and positively so that the fingers of the operators are hardly contaminated with a liquid contained in the container.

According to the invention a container for containing a liquid for use in a biochemical analysis comprises:

a liquid holding portion including an inner side wall and a bottom wall connected to the inner side wall at its lower end; and an outer side wall which surrounds the inner side wall and is connected to the liquid holding portion at its lower end, said outer side wall being spaced from the inner side wall to form a ring-shaped recess therebetween.

DECRIPTION OF THE PREFERRED EMBODIMENTS

Figure 1A:
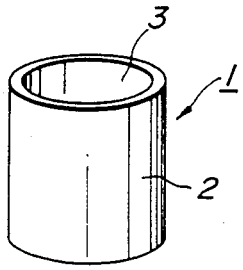
FIG. 1A (PRIOR ART)
FIGS. 1A and 1B are perspective and cross sectional views, respectively, showing a typical known sample container.
Figure 1B:
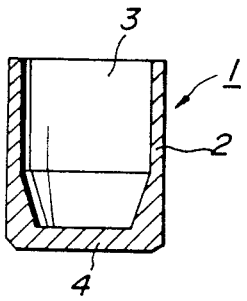
FIG. 1B (PRIOR ART)
Figure 2A:
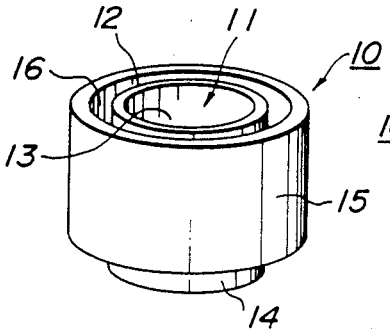
FIGS. 2A and 2B are perspective cross sectional views, respectively, illustrating a first embodiment of the container according to the invention.
Figure 2B:
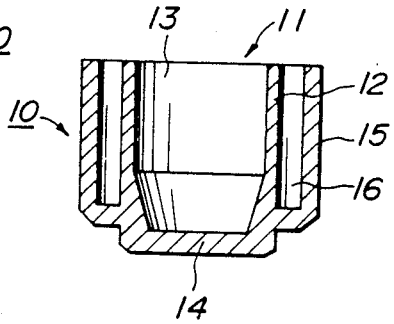

FIGS. 2A and 2B are perspective cross sectional views, respectively, showing a first embodiment of the container according to the invention. In the present embodiment, a container 10 comprises a primary liquid holding portion 11 formed by a cylindrical inner side wall 12 having an opening 13 at an upper side thereof and a bottom wall 14 connected to the inner side wall 12 at its lower side and a cylindrical outer side wall 15 which is arranged concentrically with the inner side wall 12, but is separated from the latter so to form a circular ring-shaped recess 16 therebetween, which recess is opened at an upper side. As best shown in FIG. 2B, the whole parts are integrally formed by molding of, for example, plastic material. In the present embodiment, the upper edges of inner and outer side walls 12 and 15 are at the same level.

In case of handling the container 10 of the present embodiment, an operator pinches it while his fingers are in contact with the outer surface of outer side wall 15. Therefore, even if the outer surface of inner side wall 12 is stained with a liquid, the fingers can be effectively protected against contamination by the liquid. Moreover, even if the liquid contained in the liquid holding portion 11 has overflowed onto the outer surface of inner side wall 12 due to vibration and shock during transportation, the overflowed liquid flows into the recess 16 and the outer surface of outer side wall 15 can be completely free from the liquid. Therefore, the fingers can be safely protected against contamination from the liquid. Further, since a diameter of the outer side wall 15 is greater than that of the inner side wall 12, an operator can easily and positively handle the container 10. Therefore it is difficult for the operator to turn over the container 10.

Figure 3:
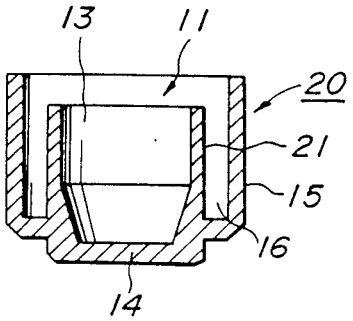
FIG. 3 is a cross sectional view depicting a second embodiment of the container according to the invention.

FIG. 3 is a cross sectional view showing a second embodiment of the container according to the invention. In embodiments which will be explained hereinafter, those parts which are the same as or similar to those shown in FIG. 2B are denoted by the same reference numerals used in FIG. 2B. In the present embodiment, a container 20 comprises an inner side wall 21 whose upper edge is lower than that of an outer side wall 15. By such a construction, it is difficult for the liquid contained in a liquid holding portion 11 to jump over the upper edge of outer side wall 15 and thus the outer surface of outer side wall 15 is further effectively kept free from the liquid.

Figure 4A:
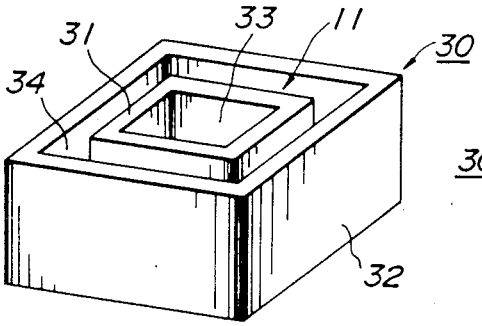
FIGS. 4A and 4B are perspective and cross sectional views showing a third embodiment of the container according to the invention.
Figure 4B:
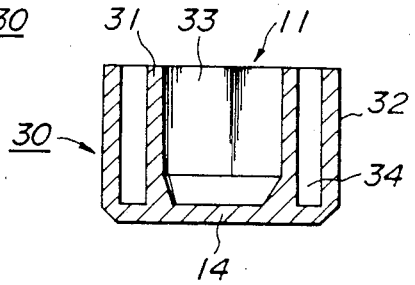

FIGS. 4A and 4B are perspective and cross sectional view, respectively, illustrating a third embodiment of the container according to the invention. In this embodiment, a container 30 comprises inner and outer side walls 31 and 32 whose lateral cross section is rectangular. Therefore, an opening 33 of the inner side wall 31 also has a rectangular shape and a recess 34 formed between the inner and outer side walls 31 and 32 has also a rectangular shape. Such a rectangular container is particularly suitable to be arranged side by side or to be stacked one on the other.

Figure 5:
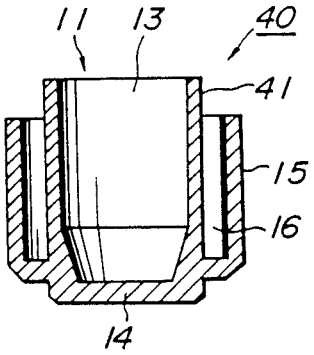
FIGS. 5 and 6 are cross sectional views showing fourth and fifth embodiments of the container according to the invention.

FIG. 5 is a cross sectional view depicting a fourth embodiment of the container according to the invention which is similar to that shown in FIG. 3. In the present embodiment, a container 40 comprises an inner side wall 41 whose upper edge is higher than that of an outer side wall 15. Therefore, it is difficult for a liquid contained in a liquid holding portion 11 to overflow beyond the inner side wall 41. The function of the outer side wall 15 is entirely the same as that of the previous embodiments. The container of the present embodiment is particularly suitable for containing a relatively large amount of the liquid.

Figure 6:
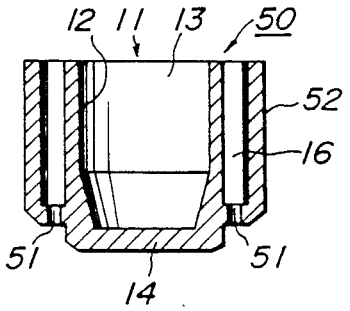

FIG. 6 is a cross sectional view illustrating a fifth embodiment of the container according to the invention. In a container 50 of the present embodiment, there are formed holes 51 in a bottom portion of an outer side wall 52. Therefore, if a liquid overflows beyond an inner side wall 12 into a recess 16, the liquid is removed from the container 50 through the holes 51, and therefore, the outer surface of outer side wall 52 is further effectively protected against the contamination with the liquid which might be stored in the recess 16 if the holes 51 are not formed. It should be noted that only one hole may be formed in the bottom portion of the outer side wall 52.

Figure 7:
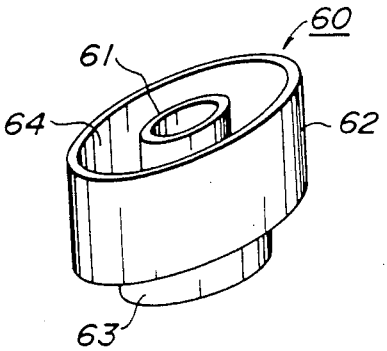
FIGS. 7, 8 and 9 are perspective views illustrating sixth, seventh and eighth embodiments of the container according to the invention.

FIG. 7 is a perspective view showing a sixth embodiment of the container according to the invention. In the present embodiment, a container 60 comprises elliptic or oval inner and outer side walls 61 and 62, bottom wall 63 and recesses 64. In some cases, an operator can handle such an oval shape container 60 much more easily.

Figure 8:
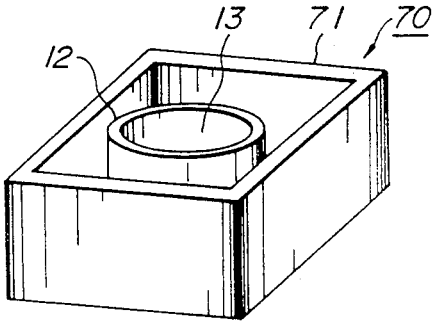

FIG. 8 is a perspective view showing a seventh embodiment of the container according to the invention. In the present embodiment, a container 70 comprises a cylindrical inner side wall 12 and a rectangular outer side wall 71. In some applications it is preferable that the inner side wall 12 has a circular opening 13, while the outer side wall 71 has a rectangular shape.

Figure 9:
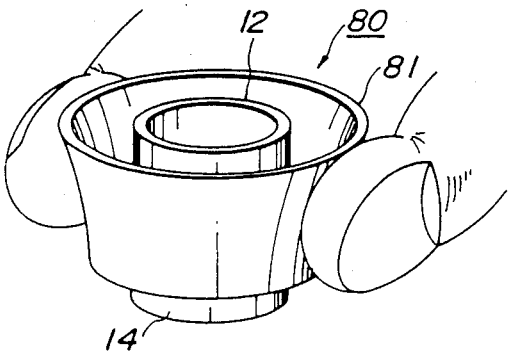

FIG. 9 is a perspective view showing an eighth embodiment of the container according to the invention. In the present embodiment, a container 80 comprises an outer side wall 81 which is not upright, but is curved outwardly and therefore, the fingers of a user can positively engage with the container 80. That is, since the upper edge of outer side wall 81 is spread outwardly viewed in an upper direction, the container is firmly clamped between the fingers and it is difficult to drop it out of the fingers.

Figure 10:
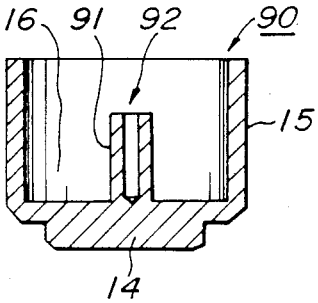
FIG. 10 is a cross sectional view depicting a ninth embodiment of the container according to the invention.

FIG. 10 is a cross sectional view showing a ninth embodiment of the container according to the invention. In this embodiment, a container 90 comprises an inner side wall 91 whose diameter is much smaller than that of an outer side wall 15. Therefore, a ring shaped recess 16 formed between the inner and outer side walls 91 and 15 has a larger volume than that of the embodiment shown in FIG. 2. However, such a large recess is not necessary for receiving a small amount of a liquid overflowed from a liquid holding portion 92. The container 90 of the present embodiment is particularly suitable for containing a very small amount of the liquid. According to the invention, since the dimension of outer side wall 15 can be selected regardless of the dimension of the inner side wall 91, the outer side wall can be designed in such a manner that the user can handle the container easily and positively.

The present invention is not limited to the embodiments described above, but many modifications and alternations may be conceived by those skilled in the art which would come within the scope of the invention. For instance, while the inner and outer side walls have been described as having a lateral cross sections of circular, oval and rectangular shapes, they may have any suitable lateral cross sectional shape such as that of a polygon. Although it is preferable to form integrally the container as a unit body, the outer side wall may be formed separately from the liquid holding portion and may be secured to the latter by, for instance, adhesive.

As explained above in detail, according to the invention the container comprises the outer side wall which surrounds the inner side wall of the liquid holding portion, Thus forming a recess therebetween and the operator pinches the outer side wall of the container between his fingers. Therefore, even if the liquid overflows beyond the inner side wall, the outer surface of the outer side wall is kept completely free from the liquid, and therefore, the fingers of the operator can be effectively protected against the contamination by the liquid. Therefore, even if the liquid includes harmful antigens, the operator can be safely protected against infection.

What is claimed is:

1. A container for containing a liquid for use in a biochemical analysis, comprising:

a primary liquid holding portion including an inner side wall and a bottom wall connected to a lower end of the inner side wall; and an overflow liquid holding portion including an outer side wall which is integrally formed with said primary liquid holding portion, both said inner side wall and said outer side wall having a circular lateral cross section, said inner side wall and said outer side wall being arranged concentrically relative to each other such that said outer side wall surrounds and is spaced from the inner side wall to form a ring-shaped recess therebetween for receiving and holding an overflow liquid, said overflow liquid holding portion further including a bottom wall which is connected between a lower end of the outer side wall and a lower end of the primary liquid holding portion, and upper edge of said inner side wall being disposed at a same level as an upper edge of said outer side wall, said bottom wall of said primary liquid holding portion being disposed lower than said bottom wall of said overflow liquid holding portion relative to said upper edges of said inner and outer side walls, said primary liquid holding portion and said overflow liquid holding portion being formed by a molding of plastic material.

* * * * *